United States Patent [19]

Anderson

[11] Patent Number: 4,974,477

[45] Date of Patent: Dec. 4, 1990

[54] SPEED WRENCH

[75] Inventor: Alan D. Anderson, Sumter, S.C.

[73] Assignee: Cooper Industries, Inc., Houston, Tex.

[21] Appl. No.: 266,821

[22] Filed: Nov. 3, 1988

[51] Int. Cl.[5] ..... B25B 13/00

[52] U.S. Cl. ..... 81/73; 279/23 R; 279/41 R; 81/37; 81/177.1

[58] Field of Search ..... 279/15 G, 23 R, 41 R, 279/46 R, 89, 104; 408/124; 81/73, 28, 35, 37, 177.1, 436

[56] References Cited

U.S. PATENT DOCUMENTS

| | | | |
|---|---|---|---|
| 470,687 | 3/1892 | Koelzer | 81/436 |
| 508,314 | 11/1893 | Hill | 279/41 |
| 1,642,569 | 9/1927 | Winslow et al. | 81/177.1 |
| 1,752,703 | 4/1930 | Simson | 81/436 |
| 2,224,195 | 12/1940 | Parsons | 81/35 |
| 2,277,961 | 3/1942 | Detmers | 279/1 A |
| 2,605,110 | 7/1952 | Blum | 279/104 X |
| 2,712,765 | 7/1955 | Knight, Jr. | 81/177.7 X |
| 2,715,926 | 8/1955 | Harris | 81/28 |
| 3,173,462 | 3/1965 | Koeppel | 81/177.1 X |

FOREIGN PATENT DOCUMENTS

| | | | |
|---|---|---|---|
| 1349520 | 4/1974 | United Kingdom | 81/73 |
| 1363932 | 8/1974 | United Kingdom | 81/73 |

*Primary Examiner*—D. S. Meislin

*Attorney, Agent, or Firm*—Ned Conley; David Rose; Donald Verplancken

[57] ABSTRACT

The speed wrench includes a plastic handle and a S-curve shaped shaft with a mount to receive tool driving or drilling inserts. The S-curve shaped shaft causes the axis of the tool to intersect the axis of the handle, thereby causing a cone-shaped pattern of rotation. The shaft permits the user to rotate the handle with wrist motion, thereby rotating the tool insert.

7 Claims, 2 Drawing Sheets

SPEED WRENCH

BACKGROUND OF THE INVENTION

This invention pertains to the field of hand-powered tools, more particularly to hand-powered shanked tools used to drive fasteners or bolts, and more particularly to hand-powered tools which employ wrist motion to turn the driving shank.

Wrist motion driving tools are well known in the art. U.S. Pat. No. 2,712,765, Knight, discloses a wrist motion hand tool having a box end for receiving a socket-type adaptor for attaching screwdriver heads and the like. U.S. Pat. No. 2,277,961, Detmers, discloses a brace adaptable for receiving screw and nut drivers. U.S. Pat. No. 1,752,703, Simpson, discloses a hand drill or screwdriver having a handle angled with respect to the shank to allow wrist motion to rotate the shank. U.S. Pat. No. 1,642,569, Winslow, et al., discloses a hand tool having an angled set off handle, and either a screwdriver or mounting chuck in rotary engagement with the handle.

These devices all have limited adaptability because they either use a unitary shank, i.e., the driver portion is uni-functional and cannot be easily replaced, or, the shanks are received within a rotary-style mounting chuck which may slip during engagement.

Bayonet-style inserts for rotary hand tools are also known in the art. For example, a bayonet connection for use on the shank of a screwdriver insert on a driver is well known. However, the driving handle in these devices are colinear with the driven insert. Therefore, the device does not have the wrist motion features of the present invention.

The present invention includes a wrist motion rotary drive tool for use with interchangeable driven shanked tools, having a bayonet connection to interlock the wrist motion driver and interchangeable driven shanked tools to overcome the cited disadvantages in the prior art. Other objects and advantages of the present invention will become apparent from the following description.

SUMMARY AND OBJECT OF THE INVENTION

The present invention is a rotary wrist motion hand tool having interchangeable driven members for driving nuts, bolts, screws and related fasteners.

The preferred embodiment of the rotary wrist motion hand tool includes a high impact plastic handle, an angled rotary shank and a bayonet coupling. The high impact plastic handle is fluted for easy gripping by the user's hand, and includes a bearing recess for rotatably retaining one end of the angled rotary shank. The angled rotary shank is a length of round steel stock bent in a slightly deformed S-shape, having a bayonet receptacle at one end. The bayonet connection is sized to releasably grip a tool having opposed flats thereon. The rotary wrist motion hand tool is also adapted for use with other bayonet mount shanked tools, such as drills and the like.

One object of this invention is to provide a rotary wrist motion hand tool which utilizes anti-rotation flats and recesses that securely grip the rotated insert.

The above and other objectives of the invention will become apparent upon review of the specification, claims and drawings.

BRIEF DESCRIPTION OF THE DRAWINGS

For a detailed description of the preferred embodiment of the invention, reference will now be made to the accompanying drawings wherein.

DESCRIPTION OF THE PREFERRED EMBODIMENT

Figure 1:
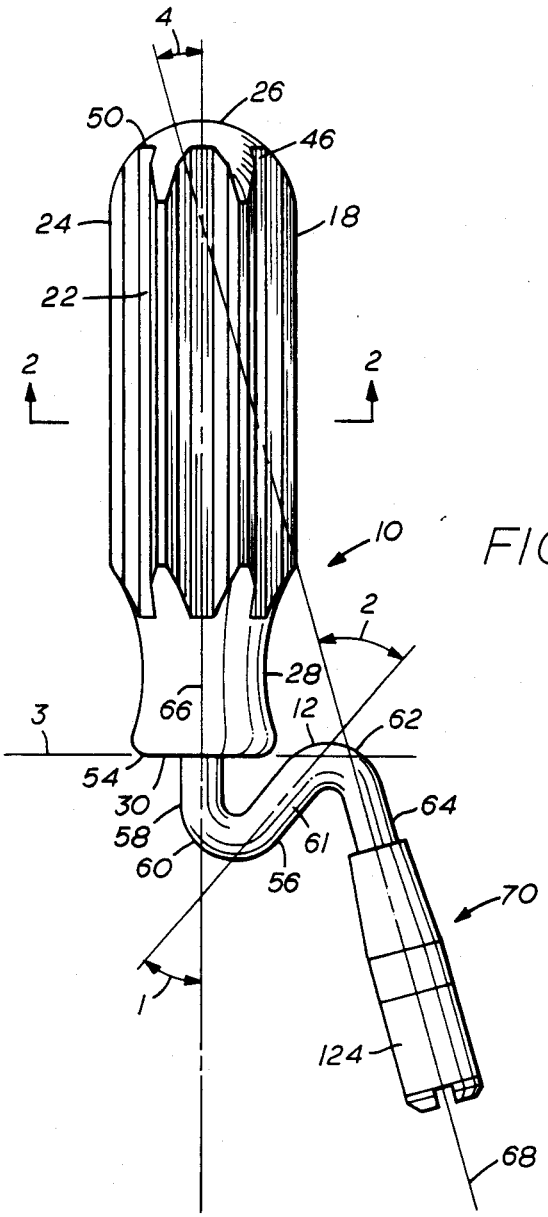
FIG. 1 is a side view of the rotary wrist motion hand tool of the present invention.
Figure 2:
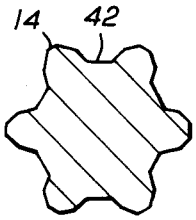
FIG. 2 is a cross-section view at plane 2—2 of the rotary wrist motion hand tool of FIG. 1.
Figure 3:
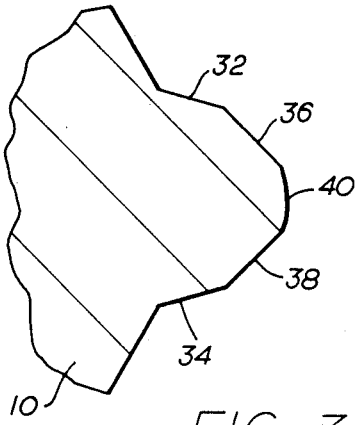
FIG. 3 is an enlarged view of the flutes on the insert handle shown in FIGS. 1 and 2.

Referring initially to FIGS. 1 to 4, the rotary wrist motion hand tool 8 of the present invention includes a handle 10 for rotatably connecting an angled shaft 12. Handle 10 includes a bore 72 for receiving a rotating sleeve 74 on the end 58 of angled shaft 12.

Sleeve 74 rotatably anchors shaft end 58 within the bore 72 of handle 10, thereby permitting the rotation of shaft end 58 with respect to handle 10 as is further described herein. The opposite or adaptor end 64 of angled shaft 12 includes an adaptor 70 mounted thereon for receiving removable inserts, or adaptor tools 104. The adaptor end 64 is disposed at an angle to handle 10, such that conical rotational cranking of handle 10 results in rotation of adaptor tool 104 to drive a fastener or other object. Tool insert 104 may include drills, or other tools for which rotational motion is desired.

Handle 10 includes flutes 14 disposed longitudinally about its circumference and terminating in a rounded base end 26 and a radial taper 28 on the other end which blends into flat end 30 connected to shaft 12. Flutes 14 are disposed equidistant to each other on the outer circumference of the handle 10, and have a hip roof shaped cross-section, shown best in FIGS. 2 and 3, including lower opposed flats 32, 34, upper opposed flats 36, 38 and rounded tip 40. Flute flats 42 are disposed between flutes 14. Handle 10 is constructed from a high-impact plastic material which can be machine bored without substantial detrimental effect to its strength or durability.

Shaft 12 is partially disposed within handle 10 at handle flat end 30. Handle flat end 30 is disposed on handle 10 opposite rounded end 26, and has a cylindrical receptacle therein for rotatably receiving shaft 12 as will be further described herein. Shaft 12 is preferably a section of zinc plated round steel stock bent into an offset S-curve 56 shape. Shaft 12 has shaft end 58, first bend 60, straight section 61, second bend 62 and adaptor end 64 preferably formed of one continuous piece of steel. The axis 66 of shaft end 58 forms angle 1 with the axis 67 of straight section 61. The axis 68 of adapter end 64 forms angle 2 with the axis 67 of straight section 61. Angle 2 of second bend 62 is preferably larger by a few degrees than angle 1 of first bend 60, thereby creating the offset S-curve 56. Angle 1 is preferably 40 degrees, and angle 2 is preferably 55 degrees, forming a preferable angular differential of 15 degrees. However, because of manufacturing tolerances, the angular differential is expected to vary from 9 to 21 degrees. Shaft end 58 is mounted in handle 10 substantially colinear with handle axis 66, as will be further described herein. The plane 3 at the handle flat end 30 intersects the second bend 62, the second bend 62 being rearward of the first bend 60 to form the S-curve 56 shape. As second bend 62 is smaller than first bend 60, the projection of shaft axis 68 of adaptor end 64 intersects handle axis 66 within handle 10 at an angle of between 9 to 21 degrees. Thus, when a user drives a screw or the like with the rotary hand tool, the user's wrist may be disposed on the shaft axis 68 and the hand moved in a conical pattern to turn the tool insert 104 around and substantially colinear with shaft axis 68. Adaptor end 64 of shaft 12 is colinearly aligned with shaft axis 68, and is adapted to receive adaptor 70 as will be further described herein.

Figure 4:
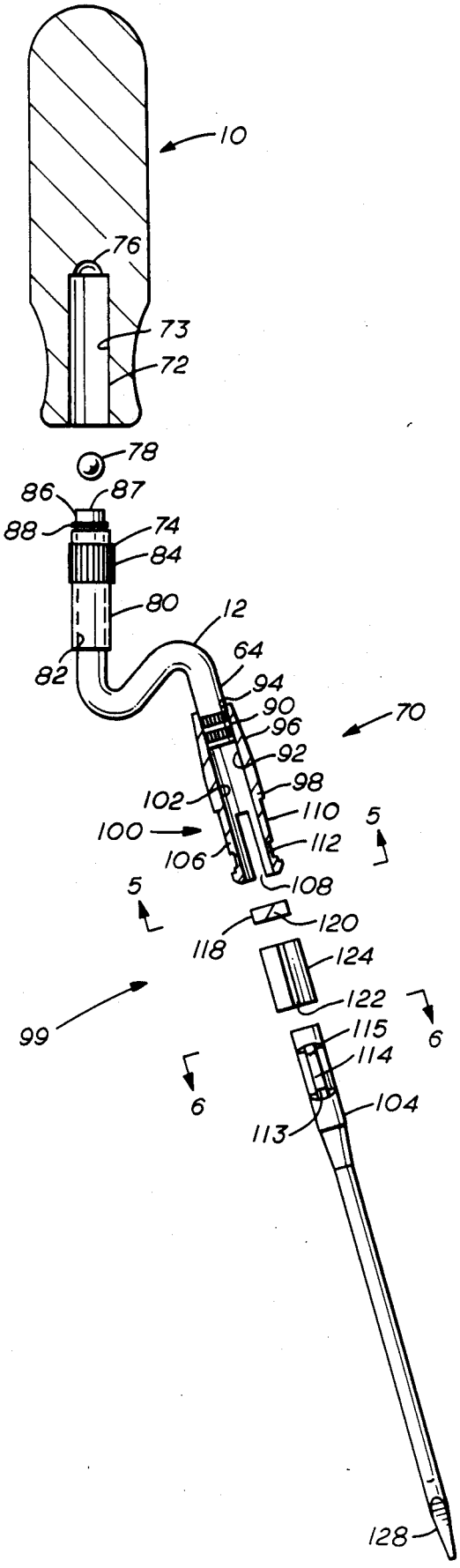
FIG. 4 is an assembly view of the rotary wrist motion tool of FIG. 1 showing the location and assembly of the shanked insert.

Referring now to FIG. 4, handle 10 and adaptor 70 of the hand tool 8 of the present invention is shown in a partial cut-a-way view to show detail. Handle 10 has shaft bore 72 dimensioned to interferingly receive first bushing sleeve 74 therein. The internal end 76 of handle bore 72 is rounded in a semicircular shape to receive ball bearing 78 therein. Ball bearing 78 rides in end 76 of bore 72 and is retained in place by first bushing sleeve 74. The outer diameter 80 of first bushing sleeve 74 includes striations 84 thereon. First striations 84 are sized to interfere with the inner wall 73 of handle bore 72 upon insertion therein to retain bushing sleeve 74 in shaft bore 72. The inner diameter 82 of bushing sleeve 74 is sized to receive shaft end 58 of shaft 12 and freely rotate. Shaft end 58 includes circumferential groove 86 in which snap ring 88 is retained. Snap ring 88 is placed into groove 86 after shaft end 58 is inserted through bushing sleeve 74 to retain sleeve 74 on shaft end 58. Ball bearing 78 is held in handle bore 72 by bushing sleeve 74, which is held in place by striations 84. Thus, angled shaft 12 is rotatably secured within handle 10 by snap ring 88. Ball bearing 78 supports angled shaft end 87 so that rotational and linear force may be applied to turn drill inserts or the like.

Adaptor 70 is a bayonet mount tool holder 99 and is shown in cut-a-way in FIG. 4. Adaptor end 64 of shaft 12 has striations 90 located thereon to interferingly engage adaptor 70 on bayonet mount inner diameter 92. Bayonet mount tool holder 99 includes shaft taper 94 located on adaptor 70 adjacent shaft 12 to guide shaft 12 into bayonet mount inner diameter 92 during assembly. Bayonet mount tool holder 99 further includes outer taper 96 which blends holder 99 from shaft taper 94 to bayonet outer diameter 98.

Figure 5:
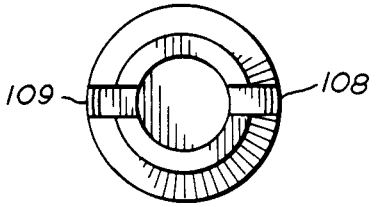
FIG. 5 is an end view of the bayonet mount of the rotary wrist motion hand tool of FIG. 4.
Figure 6:
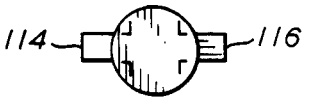
FIG. 6 is an end view of the tool shank mounted in the rotary wrist motion hand tool of FIG. 4.
Figure 7:
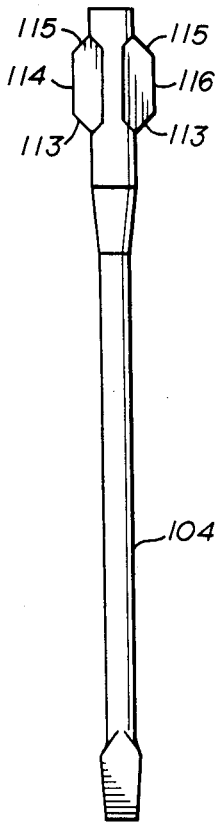
FIG. 7 is a side view of the shanked insert of the rotary motion hand tool of FIG. 4.

Bayonet mount tool holder 99 further includes mounting section 100 having a retainer section 106 and an inner diameter 102 sized to accept the shank of a tool 104. Retainer section 106 includes opposed slots 108, 109, best shown in FIG. 5, which bisect mounting section 100 into opposed arcuate halves, and retainer recesses 110, 112. Retainer recesses 110, 112 are circumferential recesses disposed about bayonet diameter 98. Opposed slots 108, 109, are sized to accept splines 114, 116, best shown in FIG. 6, located on the shank of tool inserts 104. Opposed slots 108, 109 are of sufficient depth to allow tool insert 104 to seat in holder 99 so that retainer recess 112 is located adjacent the outward end 113 of splines 114, 116. The ends 113, 115 of splines 114, 116 are tapered, to permit an inner snap ring 118 to retain tool 104 in mounting section 100. Snap ring 118 is a ring having a scarf-cut joint 120. Snap ring 118 fits in a snap ring groove 112 of holder 99 to locate snap ring 118 adjacent tapered end 113 of tool insert 104 to retain insert 104 within mounting section 100. Snap ring groove 110 holds an outer snap ring 124 in place around inner snap ring 118. Upon assembly onto holder 99, outer snap ring 124 surrounds inner snap ring 118, and has a gap 122 therein. When tool insert 104 is inserted in adaptor 70, inner and outer snap rings 118, 124 diametrically expand as splines 114, 116 are inserted into opposed slots 108, 109. Upon total insertion of tool insert 104 into mounting section 100, inner snap ring 118 rides on the end 113 of splines 116, 114, tending to force the tool 104 into the adaptor 70 by creating an axial inward force against the sloped surface of end 113. Because of the taper, the inward force of inner snap ring 118 translates into an inward retaining force on tool insert 104. Tool insert 104 is shown in FIGS. 4 and 7 with head 128 adapted for use with a slotted screwhead.

To use the rotary wrist motion hand tool 8 to turn a fastener, such as screw, the head 128 is inserted into the fastener, and the user grips the handle 10 in the palm of his hand. Flutes 14 help retain handle 10 in the user's hand. The user's fingers are placed around the handle 10, and wrist motion turns the handle 10 in a circular motion. The circular motion of the handle is in a pattern of a cone, with the peak of the cone occurring at the intersection of shaft axis 68 and handle axis 66. The half angle of the cone of rotation is equal to the angle 4 between axes 66, 68.

As handle 10 is rotated in the described cone pattern, shaft 12 freely rotates within handle 10. Because head 128 is anchored in a fastener, the movement of handle 10 in the cone pattern causes the adaptor 70, and thus tool 104 to rotate on shaft axis 68. If the user desires to put pressure on the screw, or if an insert such as a twist drill is used, the user may press down on handle 10 and the force will be partially translated into force down the shank of tool 104. Ball bearing 78 prevents the end of shaft 12 from wearing into the inside of handle 10.

Tool insert 104 has been shown and described with a screwdriver head 124. Different tool structures may be employed, including Phillips screwdriver heads, hex heads, socket heads, twist drills, and the like, without deviating from the scope of the invention. Likewise, shaft 12 has been shown with an S-curve shape, but other configurations may be employed without deviating from the scope of the invention.

While a preferred embodiment of the invention has been shown and described, modifications thereof can be made by one skilled in the art without departing from the spirit of the invention.

I claim:

1. A hand tool, comprising:

a handle having a bore therein an offset S-curved shaft having one end received within said bore;

a mounting fixture disposed at the other end of said shaft having means for axially inserting and removing tool inserts therein a tool insert mounted to said mounting fixture;

said mounting fixture including opposed longitudinal slots which receive opposed splines disposed about the exterior of said tool insert;

said mounting fixture including an inner snap ring disposed about said mounting fixture and an outer snap ring disposed about said inner snap ring and said mounting fixture.

2. The hand tool of claim 1, wherein said mounting fixture includes recesses therein for receiving said snap rings.

3. The hand tool of claim 1, wherein at least one of said splines includes a sloped contour and said slots are sized to receive said spline such that said inner snap ring is disposed on said sloped contour when said shank is fully inserted in said mounting fixture.

4. A hand tool for connection and rotation of a tool comprising;

a handle having opposed ends;

a shaft rotatably disposed on one of said ends of said handle;

said shaft having a first straight portion, a second straight portion, and a third portion, said first and second straight portions connected by a first curve and said second and third straight portions connected by a second curve, said straight portions and curves causing said shaft to have a generally S-curve shape between its ends;

said end of said shaft adjacent said first straight portion being rotatably disposed in said end of said handle and said shaft end adjacent said third straight portion having means for attaching the tool insert;

the axes of said handle and said first straight portion being collinear and the axes of said third straight portion and the tool being collinear;

said handle axis intersecting the third straight portion axis at the handle, thereby causing a cone pattern of rotation;

said attachment means including a snap ring mount for attaching the tool to said shaft; and said snap ring mount including an inner and an outer snap ring surrounding said end of the tool.

5. A hand tool for connection and rotation of a tool, comprising:

a handle having at least one end;

a shaft rotatably disposed on said end of said handle;

said shaft having a first straight portion, a second straight portion, and a third straight portion, said first and second straight portions connected by a first curve and said second and third straight portions connected by a second curve, said straight portions and curves causing said shaft to have a generally S-curve shape;

a first end of said first straight portion being rotatably disposed on said end of said handle and the tool being mounted on a second end of said third straight portion;

the axes of said handle and said first straight portion being collinear and the axes of said third straight portion and the tool being collinear;

said handle axis and the axis of said third straight portion intersecting at an angle of between 9 and 21 degrees;

said third straight portion including a snap ring mount for attaching the tool to said handle; and said snap ring mount including an inner and an outer snap ring surrounding said end of the tool.

6. The hand tool of claim 5, wherein said first curve is 37 to 43 degrees.

7. The hand tool of claim 5, wherein said second curve is 52 to 58 degrees.

* * * * *